United States Patent [19]

Ovchinnikov et al.

[11] 3,938,346

[45] Feb. 17, 1976

[54] CRYOSTAT

[76] Inventors: Viktor Sergeevich Ovchinnikov, Yaroslavskoe shosse, 28, kv. 16; Eduard Ivanovich Grigorov, prospekt Mira, 90, kv. 78; Arkady Lukyanovich Magdesian, ulitsa Zheleznodorozhnaya, 3, kv. 4; Vladimir Ivanovich Gorelikov, Serpukhovsky val, 19/43, kv. 184; Andrei Vasilievich Bermishev, ulitsa Grishina, 8, kv. 44; Alexandr Stepanovich Utkin, ulitsa Stroitelei, 10, kv. 285; Viktor Konstantinovich Fedotov, ulitsa Khalturina, 14, korpus 2, kv. 34; Vladimir Yakovlevich Volkov, Arbatskaya ploschad, 6, kv. 39, all of Moscow, U.S.S.R.

[22] Filed: Oct. 18, 1974

[21] Appl. No.: 515,979

[30] Foreign Application Priority Data

Oct. 25, 1973 U.S.S.R. ..... 1966792

[52] U.S. Cl. ..... 62/50; 62/54; 62/514 R; 220/9 LG; 220/374

[51] Int. Cl.[2] ..... F17C 7/02

[58] Field of Search ..... 62/50, 54, 514; 220/374, 220/366, 9 LG

[56] References Cited

UNITED STATES PATENTS

| | | | |
|---|---|---|---|
| 3,067,907 | 12/1962 | Friend | 220/374 X |
| 3,538,714 | 11/1970 | Kling et al. | 62/54 |
| 3,613,938 | 10/1971 | Westcott | 220/366 X |

*Primary Examiner*—William F. O'Dea
*Assistant Examiner*—Ronald C. Capossela
*Attorney, Agent, or Firm*—Haseltine, Lake & Waters

[57] ABSTRACT

A cryostat comprising a thermally insulated vessel intended to store cryogenic products and provided with a neck tightly closed with a stopper. Between the inner surface of the neck and the stopper there a helical channel is formed through which the vapor of the cryogenic product is withdrawn to the atmosphere. The ratio of the length of the helical channel to the cross-sectional area thereof is such that the excessive vapor pressure of the evaporating cryogenic products in the vessel is eliminated while the temperature of the vapor at the outlet of the neck corresponds to the temperature of the ambient atmosphere. In this way a cryostat of 34 liter capacity can be used to store biological materials at the temperature of liquid nitrogen for at least 120 days.

The proposed cryostat can be used to store biological materials at the temperature of liquid nitrogen for at least 120 days. The capacity of the cryostat is 34 liters.

8 Claims, 2 Drawing Figures

CRYOSTAT

This invention relates to cryogenic technology and more particularly it relates to cryostats used to store biological objects at cryogenic temperatures.

Cryostats are used in animal breeding to store semen of pedigree cattle at low temperatures, for example, at the temperature of liquid nitrogen; in medicine it is used to store biological preparations, for example, live tissues, blood, etc., at cryogenic temperatures.

Known in the prior art are cryostats comprising a thermally insulated metallic vessel provided with a neck.

This vessel is placed inside a vacuum-tight coat and held inside the flask by its neck and fixed in stationary fashion by stretching devices installed at the lower part of the thermally insulated vessel. The thermally insulated vessel is intended to keep cryogenic products that provide the low temperature at which biogenic materials can be stored for long time. Devices for storing biogenic materials are also placed inside said thermally insulated vessel.

The thermally insulated vessel is closed by a smooth stopper that is inserted into the neck of the vessel so that a harrow (of the order of 1/16 inch) circular channel is formed in the spaced between the inner surface of the neck and the smooth surface of the stopper. The channel serves for the evaporating cryogenic products to escape into atmosphere and thus to prevent excess pressure inside the vessel.

Moreover, the escaping gas of the cryogenic products reduces the ingress of heat at the neck, which is the main point of cold loss in the cryostat.

The disadvantage inherent in the known cryostats resides in the impossibility of storing biological material at very low temperature for long periods owing to the heat admission to the cryogenic products from the environment.

For example, the loss of liquid nitrogen due to evaporation in the known cryostats in 0.47 – 0.53 liters per day. The loss of the cryogenic agent being so high, the term of storing biological materials at the temperature of liquid nitrogen, without refilling the cryogenic agent in a cryostat having the capacity of 34 liters, is about 60 days.

It is an object of the present invention to obviate such disadvantage.

Another object of the present invention is to provide a cryostat that can be used to store biological materials at the temperature of liquid nitrogen for long periods of time.

This object is accomplished in that in a cryostat comprising a thermally insulated vessel adapted to keep cryogenic products, provided with a neck closed with a non-metallic stopper according to the invention, the stopper is tightly fitted in the neck so that between the inner surface of the vessel neck and the said stopper, a helical channel is formed beginning at one end and ending at the other end of the stopper, said channel providing an escape into atmosphere for the vapor of the cryogenic product.

It is recommendable, according to this invention, to provide said helical channel on the surface of said stopper and the inner surface of the vessel neck.

One embodiment of the present invention consists in that said helical channel is formed by a helical groove made on the inner surface of the neck of said thermally insulated vessel and by the surface of said stopper.

Owing to the helical configuration of the channel adapted to withdraw the vapor of the cryogenic products from the thermally insulated vessel into the environment, the loss of liquid nitrogen due to evaporation is reduced to 0.283, which makes it possible to store biological products in the proposed cryostats (having a capacity of 34 liters) for 120 days.

Further, objects and advantages of the present invention will hereinafter become clear from the following details description of the invention and the appended drawings, in which.

Figure 2:
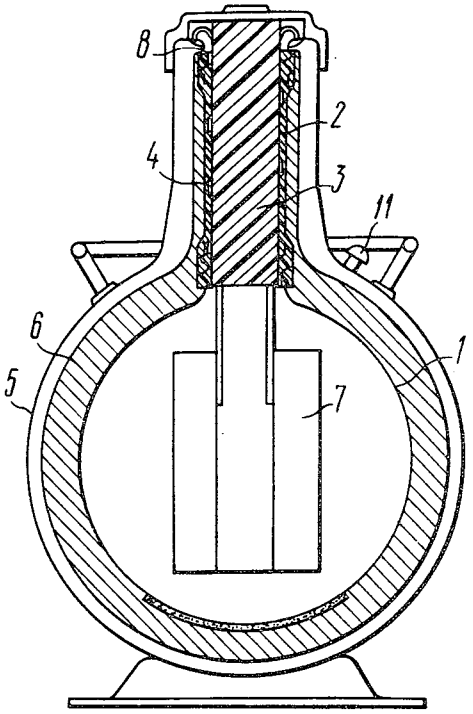
FIG. 2 is a similar section of a cryostat according to the present invention with a groove made on the inner surface of the neck.

The proposed cryostat comprises a thermally insulated vessel 1 (FIGS. 1 and 2) adapted to store cryogenic products, such as liquid air, liquid nitrogen, liquid oxygen, etc., that is, products having very low temperatures, of the order of 80–90°K. The thermally insulated vessel is made of aluminum alloys, or other materials, having a specific gravity of 2.63–2.7 and an ultimate strength of 19–32 kg/sq.mm. The neck 2 of the vessel 1 (FIGS. 1 and 2) is made of materials that meet the following requirements: low heat conduction (0.35 – 0.4 W/m × degree; low gas permeability ($1\times10^{-8}$ - $5\times10^{-6}$ cu.cm × cm/sq.cm × sec × atm) with respect to air, nitrogen and oxygen); ultimate strength from 10 to 20 kg/sq.mm, for example glass fibre impregnated with phenolformaldehyde resin, glass cloth impregnated with a mixture of epoxy and phenolformaldehyde resins doped with furfural.

The vessel 1 is closed with a stopper 3, which is inserted into the neck 2. The stopper is also preferably made of materials having low heat conduction (0.03 – 0.05 W/m × degree) and an ultimate strength 5–15 kg/sq.mm, for example of foam plastic on the basis of polyester cyanate, polystyrene, and phenolformaldehyde resin.

According to the invention, the inner surface of the neck 2, or the surface of the stopper 3 is made so that a helical channel 4 (FIGS. 1 and 2) is formed between said surfaces, providing an escape for the cryogenic product vapor from the vessel into the environment.

It is known that in order to increase the term during which biological products can be stored in cryostats, it is necessary to reduce the ingress of heat from the environment to the cryogenic products. The main share of heat admitted to the cryogenic products stored inside the cryostat is through heat insulation, the neck, and the stopper, the share of heat admitted through the other elements of the cryostat being insignificant. If highly effective thermal insulating materials in combination with vacuum between its layers are used, the main share of heat will enter the storage vessel through its neck and the stopper. Therefore, in designing the cryostat according to this invention, in order to increase the term during which bioproducts can be stored in the cryostat, we aimed our efforts at decreasing the amount of heat that penetrates into the vessel through its neck and the stopper.

We have found that the heat ingress through these elements of the cryostat can be minimized in the first instance by making the neck and the stopper of materials having low thermal conductivity (0.4 W/m × degree and 0.05 W/m × degree respectively) and in the second hand by utilizing the cold of the cryogenic product vapor to chill these elements. In other words, in working out the proposed cryostat we suggested that the vapor of the cryogenic product might be withdrawn from the vessel so that as it issues from the neck of the vessel into the atmosphere, its temperature is levelled with that of the ambient air due to the heat exchange with the surfaces of the neck and the stopper.

Investigations have shown that as the vapor of the cryogenic product is withdrawn from the vessel through a helical channel, the cold of the vapor is not utilized completely, since the amount of the heat-exchange surface is limited by the length of the vessel neck. We propose therefore that the length of the heat-exchange section should be increased to the required value by making the channel for withdrawal of the cryogenic product vapor in the form of the helical channel 4 made in between the neck 2 of the vessel and the stopper 3.

Figure 1:
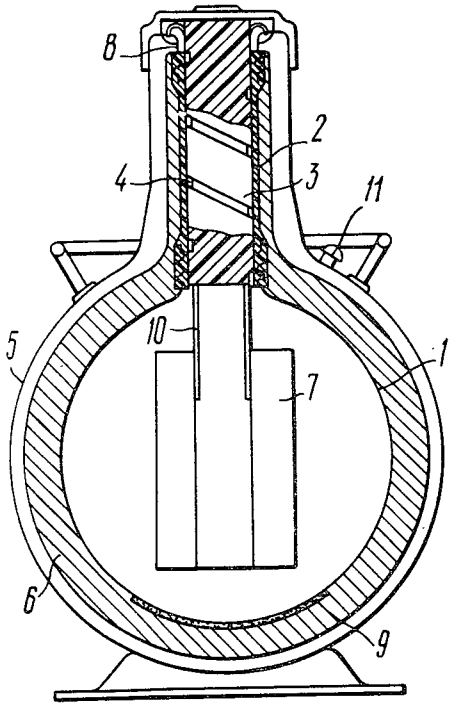
FIG. 1 is a longitudinal section of a cryostat according to the invention having a stopper with a helical groove.

Said helical channel 4 can be formed, according to this invention, either by a helical groove on the surface of the neck 2 (FIG. 2) or by a groove made on the surface of the stopper (FIG. 1).

The geometrical dimensions of the channel 4 were determined from the following requirements: firstly, the vapor of the cryogenic product should not build up excess pressure inside the vessel 1, in other words, the hydraulic resistance of the channel (which depends on the cross-section of the channel and its length) should correspond to the evolution rate of vapor of the cryogenic product, which in turn depends on the amount of heat that comes in contact with the cryogenic product, on the heat of evaporation, and on the density of the cryogenic product; secondly, the length of the channel 4 should be so selected that, as the vapor of the cryogenic products passes through the channel, all cold could be given off to the neck and the stopper, and hence the amount of heat that penetrates into the vessel should be minimized.

The invention provides for making two or more helical channels in cases where it is impossible to meet the contradictory requirements, since in order to decrease the hydraulic resistance of the channel 4 it is necessary to increase its cross section and to shorten its length, while in order to provide for an effective cooling of the neck and the stopper, it is necessary to decrease the cross-section of the channel and to increase its length.

The channel intended to withdraw the vapor of the cryogenic product made according to the proposed invention decreases the loss of cold (to decrease the loss of nitrogen to 0.283 liters per day) and makes it possible to keep biological products in cryostats having a capacity of 34 liters for as long as 120 days.

The vessel 1, intended to store the cryogenic product, is insulated with a vacuum-tight coat 5 (FIGS. 1 and 2) made of aluminum or other alloys having a specific gravity of 2.63 – 2.7 and an ultimate strength of 19–32 kg/sq-mm. The vessel 1 is fixed in the vacuum-tight coat 5 along its neck 2. The space between the vessel 1 and the vacuum-tight coat 5 is filled with a vacuum-multilayer insulation 6 (FIGS. 1 and 2) which is, for example, goffered polyethylene terephthalate film aluminized on both sides and backed with glass cloth.

The vessel 1 holds several containers, the cups of which are intended to hold ampoules with biological materials. The containers are fixed inside the vessel 1 by slots 8 (FIGS. 1 and 2) located in the upper part of the vessel neck 2.

The proposed cryostat (See FIG. 1) is used as follows.

The cryogenic product, for example, liquid nitrogen is poured into the vessel 1, having a capacity of 34 liters, through the neck 2 of the vessel 1 insulated with vacuum-multilayer insulation 6 and placed in vacuum-tight coat 5. As the cryogenic agent is loaded into the cryostat, an adsorption pump 9 (FIG. 1) located on the outside surface of the vessel 1, and intended to keep a vacuum of not lower than $1 \times 10^{-4}$ mm Hg in the space between the vessel 1 and the vacuum-tight coat 5, is started. The adsorption pump 9 keeps the specified vacuum throughout the time during which the cryogenic product is present in the vessel 1 to ensure the efficiency of the vacuum-multilayer insulation 6.

The containers 7 are placed into the vessel 1, loaded with liquid nitrogen, through the neck 2, with the aid of rods 10 (FIG. 1). The position of the containers 7 in the vessel 1 is fixed with the aid of the rods 10 and the slots 8. Then the stopper 3 in tightly inserted into the neck 2. There is a helical groove on the surface of the stopper 3, owing to which the helical channel 4, having the dimensions of 5 × 5 × 1300 mm, is formed between the inner surface of the neck 2 and the stopper 3.

The vapor of liquid nitrogen passes from the vessel along this channel 4 to chill the neck 2 and the stopper 3; at the same time the nitrogen vapor is heated by the heat that comes from the environment to the neck and the stopper. The length of the helical channel 4 (1300 mm) ensures complete utilization of the cold of the nitrogen vapor and hence the heat ingress through the neck 2 and the stopper 3 is minimized.

Biological materials can be stored in the proposed cryostat for periods not less than 120 days.

The vacuum in the cavity between the vessel 1 and said vacuum-tight coat 5 is ensured by a device 11.

What we claim is:

1. A cryostat comprising a thermally insulated vessel for storing cryogenic products including a neck, said neck being made of a material with a heat conductivity not exceeding 0.35–0.4 W/m degree and a tensile strength of 10–20 kg/mm$^2$; a non-metallic stopper having a solid cross-sectional area made of a material having a heat connductivity not exceeding 0.03–0.05 W/m degree and a tensile strength of 5–15 kg/mm$^2$, said stopper being tightly fitted into said neck of said thermally insulated vessel; a helical channel being formed between said stopper and the inner surface of said neck, said channel beginning at one end of said stopper and terminating at the other end thereof for removing vapor of the evaporating cryogenic products into the ambient atmosphere, the ratio of the length of said channel to the cross-sectional area being such that excessive vapor pressure of the evaporating cryogenic products in said vessel is eliminated, while the temperature of said vapor at the outlet of said neck corresponds to the temperature of the ambient atmosphere.

2. A cryostat as claimed in claim 1, wherein said helical channel is formed by a helical groove provided in the surface of the stopper and by the inner surface of the neck of the thermally insulated vessel.

3. A cryostat as claimed in claim 1, wherein said helical channel is formed by a helical groove provided in the inner surface of the neck of the thermally insulated vessel and by the surface of the stopper.

4. A cryostat as claimed in claim 1, wherein the ratio of the cross section of said channel to its length is equal to 1:52 respectively.

5. A cryostat as claimed in claim 1 comprising thermal insulation on said vessel and a vacuum-tight coating on the insulation.

6. A cryostat as claimed in claim 1 wherein the cross-section of the channel is 5×5 mm and the length of the channel is 1300mm.

7. A cryostat as claimed in claim 1 wherein said vessel is aluminum.

8. A cryostat as claimed in claim 1 wherein said stopper is constituted of a synthetic resin plastic.

* * * * *